United States Patent [19]

Baugh et al.

[11] 4,375,240

[45] Mar. 1, 1983

[54] WELL PACKER

[75] Inventors: John L. Baugh; Phillip H. Manderscheid; James W. Montgomery, all of Houston, Tex.

[73] Assignee: Hughes Tool Company, Houston, Tex.

[21] Appl. No.: 213,926

[22] Filed: Dec. 8, 1980

[51] Int. Cl.[3] ..... E21B 33/126

[52] U.S. Cl. ..... 166/387; 166/120; 166/212

[58] Field of Search ..... 166/387, 120–122, 166/212

[56] References Cited

U.S. PATENT DOCUMENTS

| | | | |
|---|---|---|---|
| 3,054,450 | 9/1962 | Baker | 166/120 |
| 3,342,268 | 9/1967 | Brown | 166/124 |
| 3,391,742 | 7/1968 | Davis | 166/139 |
| 3,392,783 | 7/1968 | Reed | 166/303 |
| 3,410,348 | 11/1968 | Page | 166/120 |
| 3,920,075 | 11/1975 | Braddick et al. | 166/290 |
| 3,991,826 | 11/1976 | Baugh | 166/120 |
| 4,263,968 | 4/1981 | Garner | 166/120 |
| 4,285,400 | 8/1981 | Mullins | 166/120 X |
| 4,296,806 | 10/1981 | Taylor et al. | 166/120 |

*Primary Examiner*—Ernest R. Purser

*Attorney, Agent, or Firm*—Robert A. Felsman; Charles D. Gunter, Jr.

[57] ABSTRACT

Disclosed is a hydraulically operable well packer for releasable setting within a well conduit, including a seal assembly for sealing the packer to the conduit and an anchor assembly for anchoring the packer to the conduit. The seal assembly includes sealing members for engaging the conduit as well as secondary sealing members for engaging a central mandrel of the packer, both sets of sealing members being constructed of material which permits the mandrel to remain sealed to the well conduit in the presence of high temperatures. The packer may be released by straight longitudinal movement of the mandrel relative to the outer packer assembly.

9 Claims, 14 Drawing Figures

WELL PACKER

BACKGROUND OF THE INVENTION

1. Field of the Invention

The present invention pertains to techniques for sealing cylindrical members to circumscribing conduits. More particularly, the present invention relates to well tools, such as well packers, for selectively sealing a tubing string, for example, to a surrounding well conduit such as provided by casing or well liner, and is suitable for use in high-temperature applications.

2. Description of Prior Art

Well packers and other downhole equipment may be exposed to high temperatures. For example, known secondary recovery techniques for producing hydrocarbons include certain thermal recovery operations. Such thermal recovery operations include fire flooding and steam injection. In the case of fire flooding, oil sand about the periphery of a high viscosity oil formation is ignited and the fire maintained by the injection of air through wells about the formation horizon. As the combustion front advances through the formation, the oil decreases in viscosity and increases in mobility, moving toward one or more producing wells communicating with the interior of the formation.

Steam may be injected into one or more injection wells to reduce the viscosity of formation oil which may then be removed by a producing well. Alternatively, steam may be circulated down a well through which the reduced-viscosity oil is produced, the oil being isolated from the steam within the well bore.

Where downhole equipment is subject to high temperatures, such as in the cases of fire flooding or steam injection, variations in the length of the equipment, and particularly the tubing string, due to wide-ranging temperature changes must be accommodated. U.S. Pat. No. 3,391,742 discloses a mechanically-set, retrievable well packer particularly applicable for high-temperature well operations. After the packer is set, the tubing string by which the packer is run in the well may be moved longitudinally relative to the outer packer assembly, which is sealed and anchored to the surrounding well conduit, without unseating the packer. A dual mandrel assembly provides the capability of circulating steam while producing hydrocarbons through the packer.

SUMMAY OF THE INVENTION

Apparatus according to the present invention includes means for selectively engaging a conduit circumscribing the apparatus which includes a generally cylindrical member, or mandrel, passing through the apparatus. In particular, the apparatus may provide sealing engagement between the cylindrical member and the surrounding conduit while permitting axial movement of the cylindrical member relative to the conduit without interferring with the sealing engagement. The apparatus is operable to engage the conduit by longitudinal movement of setting means in response to fluid pressure. Collet-mounted latching apparatus are operable by movement of a stop device to release the engagement means.

The present invention is illustrated in a well tool, including a well packer, to be releasably set internally of a well conduit. The packer includes a central mandrel generally circumscribed by an outer packer assembly. The outer assembly includes seal means, for selective radial expansion into sealing engagement with the conduit, anchoring means, for selective radial extension into anchoring engagement with the conduit, and setting means for so selectively propelling the seal means and the anchoring means radially into engagement with the conduit. The seal means may include a plurality of annular seal members mounted on a tubular member between retainers, one of which is fixed relative to the tubular body. The setting means extends the seal members radially by driving the second retainer axially relative to the tubular member to axially compress the seal members and thereby radially extend them.

The anchoring assembly includes a plurality of slip members which may be wedged radially outwardly by opposed cone members cooperating with camming surfaces connected to the slip members. With the anchoring assembly set in gripping engagement with the surrounding conduit, the slip members are thus wedged in both senses along the axial direction of the well tool. The well tool is thus effective to seal the outer assembly against fluid pressure acting in either longitudinal sense along the well.

The setting means includes a first piston which responds to hydraulic pressure introduced through the tubular member to so drive the second retainer axially to compress the seal members, and to wedge the cone members against the slip members. Concurrently, the hydraulic pressure acting on the first piston acts ultimately on the tubular member in the opposite axial direction sense. Consequently, the setting pressure effectively compresses the seal means and the anchoring means from both axial direction senses.

A one-way ratchet locking mechanism includes a pair of threaded members respectively responsive to the setting hydraulic pressure in opposite axial direction senses. Consequently, as the seal means and the anchoring means are propelled into their respective set configurations, the locking mechanism is tightened to hold the packer in anchoring and sealing engagement with the surrounding well conduit.

The sealing means also includes a second sealing device which seals the outer packer assembly to the packer mandrel, which may form a continuation of the tubing string by which the packer is positioned in the well. Such engagement between the outer packer assembly and the tubing string is maintained though the tubing string and mandrel may be moved longitudinally relative to the set packer outer assembly. One or more ports, by which hydraulic pressure may be communicated through the mandrel to set the packer, may be repositioned relative to the set outer packer assembly by selective movement of the tubing string and mandrel so that fluid may be selectively communicated through the mandrel wall above or below the set outer packer assembly.

A well packer according to the present invention may be selectively released from its set configuration within a conduit by a straight pull of the tubing string sufficient to disengage the tubular body from the locking mechanism for longitudinal movement relative thereto. A system of latching dogs, mounted on collet arms, prevents such longitudinal movement between the tubular member and the locking mechanism until the tubing string is so manipulated to remove a stop device from the dogs to free the collect arms to flex and thereby allow the dogs to ride around a latching shoulder.

The present invention provides a well tool, such as a well packer, which may be set by application of fluid pressure, and which thereafter maintains sliding sealing engagement between the tubing string and the surrounding well conduit. Thus, variations in the length of the tubing string due to wide-ranging temperature changes within the well will not disturb the set configuration of the packer or the seal between the tubing string and the conduit.

DESCRIPTION OF PREFERRED EMBODIMENTS

Figure 1A:
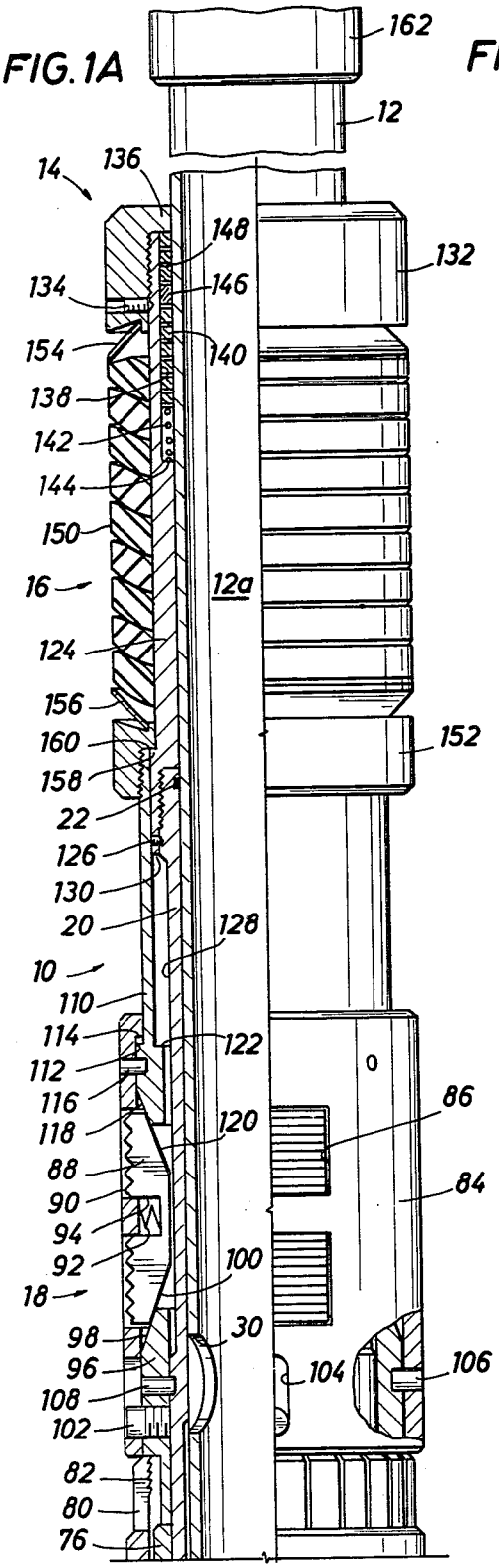
FIGS. 1A and 1B combined provide an elevation in partial section of a well packer according to the present invention in configuration to be run in a well conduit, FIG. 1A illustrating the upper portion of the apparatus and FIG. 1B illustrating the lower portion.
Figure 1B:
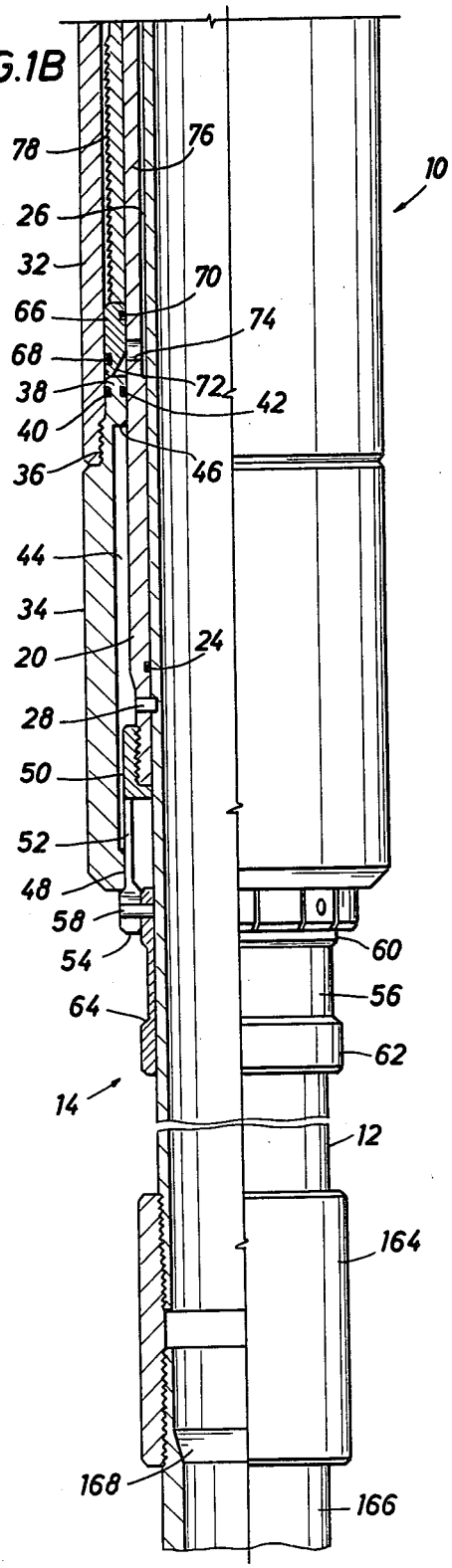

Apparatus according to the present invention, in the form of a well packer, is shown generally at 10 in FIGS. 1A and 1B combined. The packer 10 includes a central, tubular mandrel 12 featuring a cylindrical central passage 12*a*. The mandrel 12 is generally circumscribed by an outer assembly 14 of the packer 10.

The outer packer assembly 14 includes a seal assembly 16 and an anchoring assembly 18, both radially extendable as described hereinafter to engage a surrounding conduit. Additionally, the seal assembly 16 provides sliding seal engagement between the outer packer assembly 14 and the mandrel 12 as discussed in further detail hereinafter.

As part of the outer packer assembly 14, an extended tubular member 20 circumscribes the mandrel 12, and is sealed thereto by O-ring seals 22 and 24 carried in appropriate annular grooves in the tubular member. An elongate annular recess 26 is formed between the tubular member 20 and the mandrel 12 by an increased internal diameter profile of the tubular member.

In the running in configuration of FIGS. 1A and 1B, the outer packer assembly 14 is connected to the mandrel 12 by four shear pins, or screws, 28 (only one visable) joining the tubular member 20 to the mandrel. With the shear pins 28 intact, the mandrel 12 and the tubular member 20 are mutually longitudinally aligned so that one or more ports 30 (only one shown) in the mandrel at least partially overlaps the recess 26. The seals 22 and 24 are positioned toward opposite longitudinal ends of the tubular member 20, and on opposite axial sides of both the recess 26 and, in the running in configuration, the ports 30.

Upper and lower sleeve members 32 and 34, respectively, generally surround the tubular member 20, and are mutually threadedly connected at 36. The lower sleeve member 34 features an annular piston head 38 extending axially above the connection at 36 and positioned in the annular region between the tubular member 20 and the upper sleeve member 32. O-ring seals 40 and 42, carried in appropriate annular grooves, seal the piston head 38 to the upper sleeve member 32 and the tubular member 20, respectively.

The lower sleeve member 34 is undercut to form an elongate annular recess 44 whose upper end is defined by an annular shoulder 46 of the lower sleeve member, and whose lower limit is defined by an inwardly-extending annular shoulder 48 toward the bottom of the lower sleeve member.

Within the recess 44, the tubular member 20 is threadedly connected to a collet assembly 50 featuring downwardly-extending collet arms 52. Each collet arm 52 ends in an enlarged dog, or latch member, 54 with the enlargement of each dog extending radially outwardly and radially inwardly.

In the running in configuration illustrated in FIG. 1B, the collet arms 52 lie along the radially inner surface of the shoulder 48 with the latch members 54 abutting the shoulder 48 as shown, the collet arms 52 being in the relaxed state. The collet assembly 50 is thus prevented from upward longitudinal movement relative to the shoulder 48 in the configuration of FIG. 1B, unless the dogs 54 are permitted to ride radially inwardly about the shoulder 48, thus flexing the arms 52. To prevent such radially inward movement by the dogs 54 and to maintain the collet assembly 50 and the attached tubular member 20 latched against such upward longitudinal movement relative to the lower sleeve member 34, a back-up collar 56 is provided, surrounding the mandrel 12 and fixed against longitudinal movement relative to the collet assembly 50 by five shear pins, or screws, 58 (only two shown) anchoring the collar 56 to the dogs 54. The radially outer surface of the collar 56 features upper and lower annular shoulders 60 and 62 respectively, axially separated by an annular profile 64 of lesser outer diameter. The radial extent of the upper shoulder 60 is sufficient to underlie the dogs 54 as a stop to maintain the latter against radially inward movement that would otherwise allow the dogs to ride axially upwardly past the shoulder 48. Thus, with the shear pins 58 intact, the shoulder 60 of the collar 56 cooperates with the lower sleeve member shoulder 48 to lock the collet assembly 50 and the tubular member 20 against upward axial movement relative to the lower sleeve member 34 and the upper sleeve member 32.

An annular floating piston 66 is positioned in the annular region between the upper sleeve member 32 and the tubular body 20 above the piston head 38. O-ring seals 68 and 70, carried in appropriate annular grooves in the piston 66, seal the piston to the upper sleeve member 32 and the tubular body 20, respectively. The bottom extent of the piston 66 is undercut to form a frustoconical lower surface, thereby establishing a pressure chamber 72 between the piston 66 and the piston head 38. One or more radial ports 74 in the tubular member 20 communicate between the pressure chamber 72 and the recess 26 and, therefore, the mandrel ports 30 and the mandrel passage 12*a*.

An elongate locking ring 76 is positioned above the piston 66 in the annular region between the upper sleeve member 32 and the tubular member 20. The exterior surface of the locking ring 76 features downwardly-facing buttress threads, or annular teeth, 78 of small pitch. The upper sleeve member 32 ends in upwardly-extending collet fingers 80, whose inner annular surfaces are lined with upwardly-facing buttress threads, or teeth, 82 of pitch equal to that of the locking ring threads 78. The construction of the collet fingers 80 is such that the locking ring 76 may be propelled upwardly relative to the upper sleeve member 32, with the resiliency of the collet fingers permitting the ring threads 78 to ratchet upwardly along the collet finger threads 82. However, with the ring threads 78 meshed with the collet finger threads 82, the locking ring 76 is prevented from longitudinal downward movement relative to the upper sleeve member 32. Therefore, with the dogs 54 in latching configuration as shown in FIG. 1B to prevent relative upward movement of the tubular body 20 with respect to the lower sleeve member 34, if the locking ring 76 is raised to mesh the ring threads 78 with the collet finger threads 82, the ring 76 is locked against downward movement relative to the tubular member 20.

The anchoring assembly 18 includes a generally tubular slip cage 84 featuring four sets of paired windows 86. Four slip members 88 are mounted on the slip cage 84 for radial movement relative thereto. Each of the slip members 88 features upper and lower gripping surfaces 90 positioned to extend radially through corresponding windows 86. The paired windows 86 are thus provided mutually axially displaced for each slip member 88, with the wall of the slip cage 84 between the paired windows serving to confine a conical coil spring 92 residing in a recess 94 in each of the slip members. The conical springs 92 bias the slip members 88 radially inwardly relative to the wall of the slip cage 84, and thus serve to maintain the gripping surfaces 90 retracted in the absence of forces propelling the slip members radially outwardly. Each of the gripping surfaces 90 is constructed of horizontally-oriented gripping edges which provide gripping contact in both senses of the longitudinal direction of the packer 10. The gripping surfaces 90 are generally curved to follow the cylindrical internal surface construction of well casing with which the slip members 88 may engage.

A lower tubular spreader cone assembly 96 extends upwardly within the slip cage 84, and there features an upwardly-facing frustoconical wedging surface 98 that is generally complementary to downwardly-facing, slanted lower cam surfaces 100 of the slip members 88. The lower cone assembly 96 extends downwardly to abut the top of the locking ring 76.

Four pins 102 extend radially outwardly from the lower cone assembly 96, and reside in elongate, axially-oriented slots 104 in the slip cage 84 to limit relative movement between the lower cone assembly and the slip cage. Six outer shear pins, or screws, 106 (only one shown) initially connect the lower cone assembly 96 to the slip cage 84 to prevent any relative movement between these two elements. Three inner shear pins, or screws, 108 (only one shown) initially connect the lower cone assembly 96 to the tubular member 20 to prevent any relative movement between these two elements.

An upper, tubular spreader cone assembly 110 extends downwardly into the top of the slip cage 84, and features an annular shoulder 112 which fits under an inwardly-directed flange, or shoulder, 114 of the slip cage, the two shoulders 112 and 114 defining the limit of axial movement of the cone assembly 110 upwardly relative to the slip cage. Five shear pins, or screws, 116 initially connect the upper cone assembly 110 to the slip cage 84 to prevent relative movement between these two elements.

The lower portion of the upper cone assembly 110 features a downwardly-facing, frustoconical wedging surface 118 which is generally complementary to upwardly-facing, slanted upper cam surfaces 120 of the slip members 88. The upper cone assembly 110 also features an inwardly-extending annular shoulder 122.

The tubular member 20 is continued upwardly by a seal mandrel 124 to which the member 20 is threadedly connected. A set screw 126 locks the threaded connection between the seal mandrel 124 and the tubular member 20. Below its connection with the seal mandrel 124, and above the position of the shear pins 108, the tubular member 20 features an external profile 128 of lesser outer diameter. The profile 128 accommodates the radially inward extension of the slip members 88 in their respective retracted configurations, as illustrated in FIG. 1A. At the upper extent of the profile 128, the seal mandrel 124 provides an annular shoulder 130.

A seal retainer ring 132 is threadedly connected to the top of the seal mandrel 124, with the threaded connection therebetween locked by a set screw 134. The retainer ring 132 features an inwardly-extending flange, or shoulder, 136 which overlies an internal profile 138 of the seal mandrel 124. A mandrel seal assembly 140 resides in the profile 138, axially compressed between the shoulder 136 and a coil spring 142, which is compressed between the elements of the mandrel seal assembly and a seal mandrel shoulder 144 defining the lower limit of the profile 138. The mandrel seal assembly 140 includes a plurality of annular, resilient seal members 146 interleaved with metal spacers 148. The mandrel seal members 146 may be asbestos packing, particularly suitable for use in high temperature environments. The axial compression of the seal members 146 by operation of the coil spring 142 induces radial expansion of the seal members, insuring a fluid-tight, slidable sealing engagement between the exterior surface of the mandrel 12 and the seal mandrel 124.

A plurality of resilient, annular seal members 150 is mounted on the outer surface of the seal mandrel 124 between the retainer ring 132 and a compression ring 152 which is threadedly connected to the top of the upper cone assembly 110. The primary seal members 150 may be asbestos packing suitable for exposure to high temperatures as in the case of the mandrel seal members 146. The primary seal members 150 expand radially relative to the seal mandrel 124 upon axial compression. Such axial compression of the seal members 150 may be effected upon relative movement of the compression ring 152 toward the retainer ring 132. The opposing faces of the two rings 132 and 152 are appropriately grooved to receive frustoconical washers 154 and 156, respectively. Upon relative movement of the compression ring 152 toward the retainer ring 132, the washers 154 and 156 transmit at least part of the axial compression forces to the seal members 150, and flex appropriately to accommodate the deformation of the seal members 150.

The seal mandrel 124 features an outwardly-extending annular shoulder 158 which underlies an inwardly-extending shoulder 160 of the compression ring 152. Abutting engagement of the shoulders 158 and 160, as in the running in configuration illustrated in FIG. 1A, limits the downward movement of the compression ring 152 relative to the seal mandrel 124.

The mandrel 12 may form an extension of an operating string whereby the packer 10 may be positioned in a well. For example, a collar 162 may connect the top of the mandrel to the operating string extending to the top of the well. A collar 164 may connect the bottom of the mandrel 12 to a continuation of the operating string below the packer 10. As part of that operating string continuation, a catcher sub 166 may be connected to the collar 164 as shown. The sub 166 includes a reduced diameter portion marked by an upwardly-facing frustoconical seating surface 168 used to catch a valve member, such as a ball 170 (FIG. 2B) to selectively seal the tubing string and mandrel 12 so that fluid pressure may be applied to the packer 10 for setting purposes, as discussed hereinafter. Aside from the catcher sub 166 with its seating surface 168, the central passage of the tubing string may be uninterrupted through the packer 10 and the remaining members of which the tubing string is comprised, the central mandrel passage **12*a*** being aligned with and of the same cross-sectional size as the central passage through the remainder of the tubing string.

The number and shear limit of the individual shear pins or screws 28, 58, 106, 108 and 116 are choosen so that the sets of shear pins will break in the desired order for setting the packer 10 and releasing the packer from its set configuration. The shear pins 106, 108 and 116 are broken during the setting operation. The shear pins 58 are broken to release the packer 10 from its set configuration. The shear pins 28 serve to support the outer packer assembly 14 on the mandrel 12 during the running in operation and to maintain the relative longitudinal position of the outer packer assembly 14 relative to the mandrel 12 during the setting operation. Once the packer 10 is set, the pins 28 may be selectively broken at any time by longitudinal movement of the mandrel 12 relative to the outer packer assembly 14.

Figure 2A:
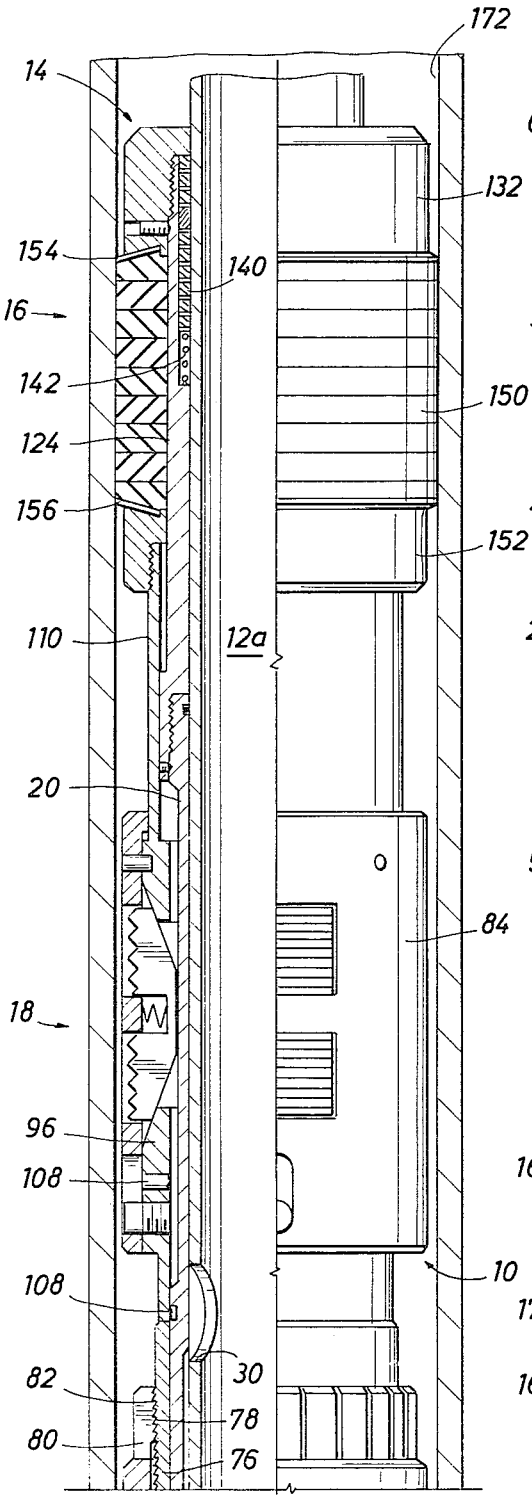
FIGS. 2A and 2B combined are similar to FIGS. 1A and 1B combined, with the seal assembly of the well packer moved into sealing engagement with a circumscribing casing.
Figure 2B:
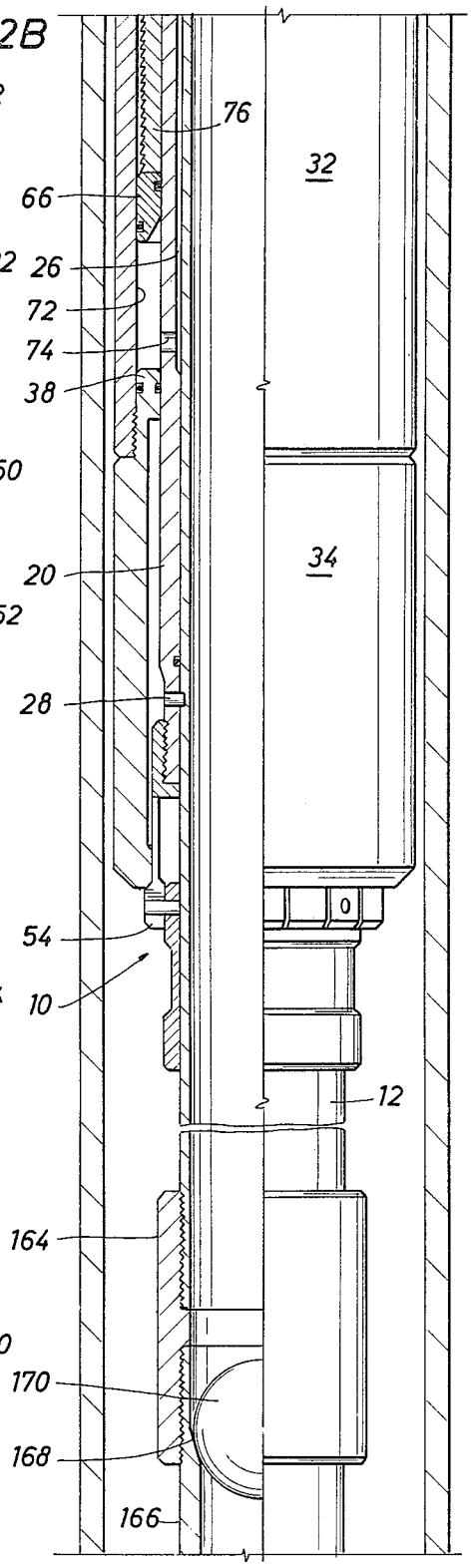

With all shear pins 28, 58, 106, 108 and 116 intact as illustrated in FIGS. 1A and 1B, the packer 10 may be run in a well on a tubing string within a well conduit 172, for example, as shown in FIGS. 2A and 2B. The conduit 172 may be casing or liner, for example, positioned within the well bore.

When the packer 10 has been manipulated by the tubing string to the location within the conduit 172 in which the packer is to be set, a ball valve 170 is dropped through the tubing string and the mandrel central passage **12*a* to be caught by the seating surface 168 of the catcher sub 166. Contact between the ball 170 and the seating surface 168 provides a seal of the operating string below the packer 10 against fluid pressure communicated to the operating string from the surface. In practice, the fluid pressure may be provided by hydraulic fluid pumped from the surface. Such pumping may be controlled to provide the necessary hydraulic pressure at the packer 10** to set the packer.

As the hydraulic pressure is pumped from the surface to the central mandrel passage **12*a*, the fluid under pressure is communicated through the mandrel bore 30 to the recess 26, the port 74 and the pressure chamber 72. In response to the hydraulic pressure in the pressure chamber 72, the piston head 38 is urged downwardly and the piston 66 is urged upwardly, both relative to the tubular member 20. However, the lower sleeve member 34 is locked against downward movement relative to the tubular member 20 by the dogs 54. Consequently, the piston 66 is propelled upwardly relative to the tubular member 20, which remains longitudinally fixed relative to the mandrel 12 to which the tubular member is fastened by the shear pins 28**.

As the piston 66 is propelled upwardly, it drives the locking ring 76 upwardly against the lower cone assembly 96. With sufficient hydraulic pressure applied in the pressure chamber 72, the inner shear pins 108 break to permit the lower cone assembly 96, and elements attached thereto, to move upwardly relative to the tubular member 20. Thus, the upper cone assembly 110 propels the compression ring 152 upwardly toward the retainer ring 132, which is fixed against longitudinal movement relative to the tubular member 20 by threaded connection to the seal mandrel 124. Consequently, the seal members 150 are axially compressed and, as noted hereinbefore, expand radially to sealingly engage the interior surface of the well conduit 172.

As the seal members 150 are axially compressed and extended radially, the washers 154 and 156 are flexed axially away from the seal members 150 and against the rings 132 and 152, respectively. Ultimately, all seal members 150 may be sufficiently radially extended to engage the conduit 172 and provide the sealing engagement between the packer 10 and the conduit.

Before the seals 150 are completely set, the locking ring will have advance sufficiently upwardly to engage its threads 78 with the threads 82 of the collet fingers 80. As noted hereinbefore, the collet fingers 80 may flex sufficiently outwardly to permit the locking ring 76 to ratchet upwardly along the threads 82. However, the orientation of the buttress threads 78 and 82 are such that, once these threads mesh, any tendency of the locking ring 76 to move downwardly relative to the upper sleeve member 32 will not flex the collet fingers 80 radially outwardly. Consequently, the engagement between the threads 78 and 82 is such as to permit only one way movement of the locking ring 76 relative to the upper sleeve member 32: the locking ring 76 may be raised relative to the sleeve member 32 but, once raised, the locking ring may not move downwardly relative to the upper sleeve member 32. Therefore, as the hydraulic pressure applied to the pressure chamber 72 ultimately drives the seal members 150 into sealing engagement with the conduit 172, the setting of the seal assembly 16 in this manner is locked by the cooperative engagement of the locking ring threads 78 with the upper sleeve member threads 82.

Figure 3A:
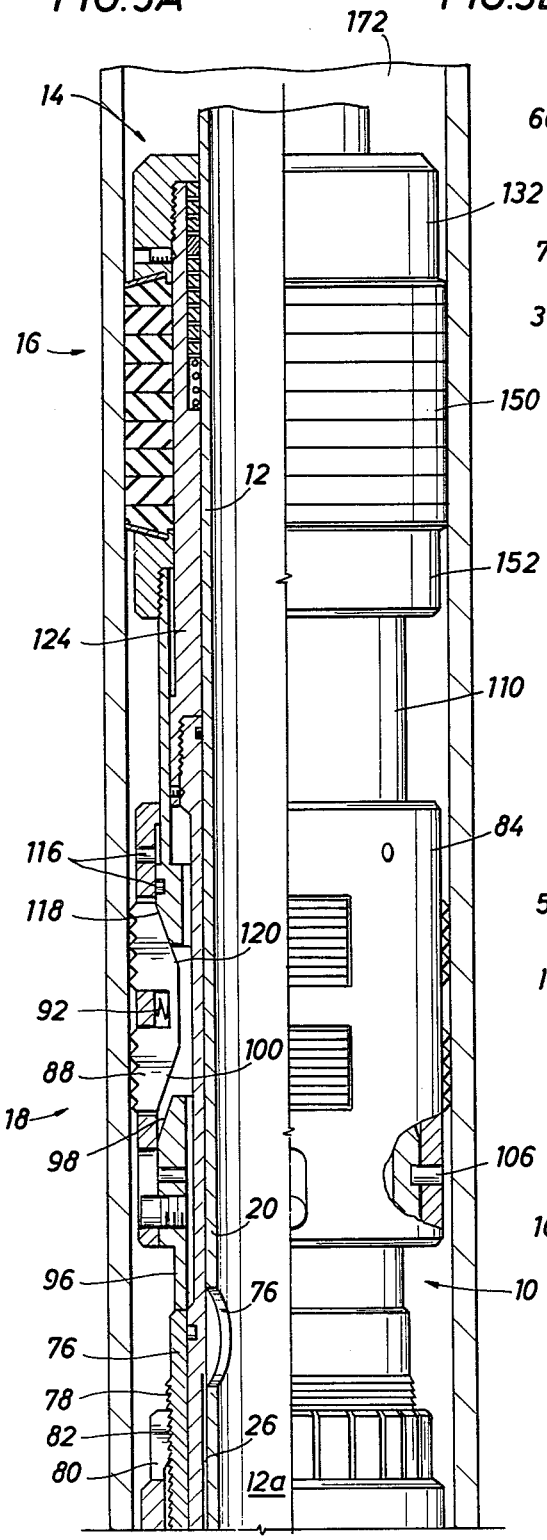
FIGS. 3A and 3B combined similarly illustrate the well packer of FIGS. 2A and 2B, with the slip members of the packer partially anchored against the surrounding well casing.
Figure 3B:
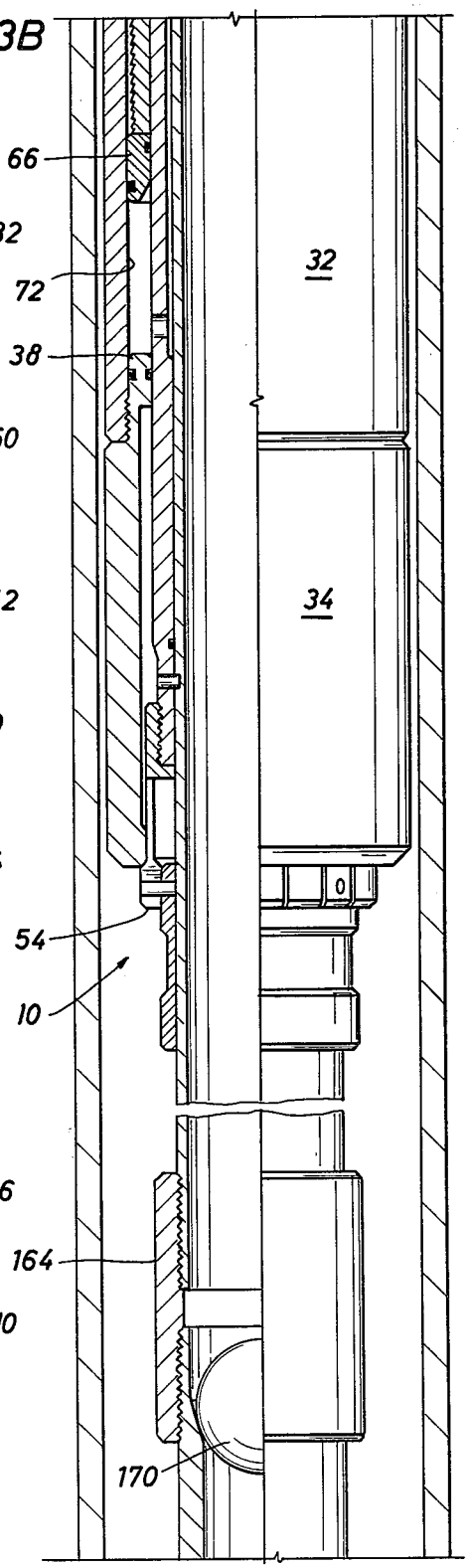

The application of increased hydraulic pressure to the pressure chamber 72 causes the anchoring assembly 18 to set. As illustrated in FIGS. 3A and 3B, as the hydraulic pressure in the chamber 72 further urges the piston 66 upwardly relative to the tubular member 20, the shear pins 116 break, allowing the lower cone assembly 96 to drive the slip cage 84 upwardly relative to the upper cone assembly 110.

During this phase of the setting operation, the slip members 88, moving upwardly with the slip cage 84, are driven against the frustoconical wedging surface 118 of the upper cone assembly 110. The camming surfaces 120 thus cooperate with the wedging surface 118 to wedge the slip members 88 radially outwardly so that the surfaces 90 grippingly engage the inner surface of the well conduit 172. At the same time, the locking ring 76 is further ratcheted upwardly relative to the collet fingers 80, with the meshing of the buttress threads 78 and 82 continuing to mechanically lock the packer 10 in the configuration to which it has been propelled by application of hydraulic pressure to the pressure chamber 72. Thus, the slip members 88 are held wedged between the conduit 172 and the upper cone assembly 110 by the slip cage 84, which is anchored to the lower cone assembly 96 by the shear pins 106, the lower cone assembly being held by abutment against the locking ring 76.

The upper cone assembly 110, which, with the compression ring 152, maintains the primary seal members 150 in set configuration, is prevented from moving downwardly relative to the well conduit 172 and the tubular member 20 by the wedging cooperation between the wedging surface 118 and the cam surfaces 120. Any tendency of the upper cone assembly 110 to move downwardly is accompanied by the slip members 88 wedging into tighter gripping engagement with the conduit 172.

Figure 4A:
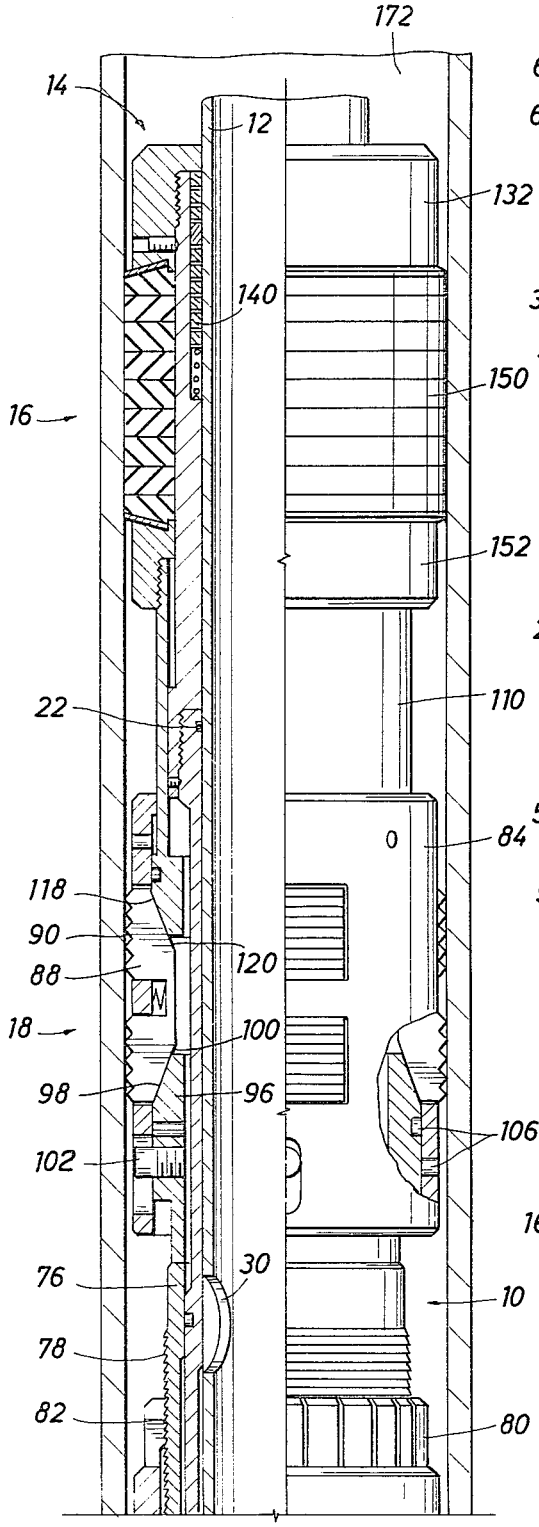
FIGS. 4A and 4B are views similar to FIGS. 3A and 3B, but illustrate the packer in its fully set configuration.
Figure 4B:
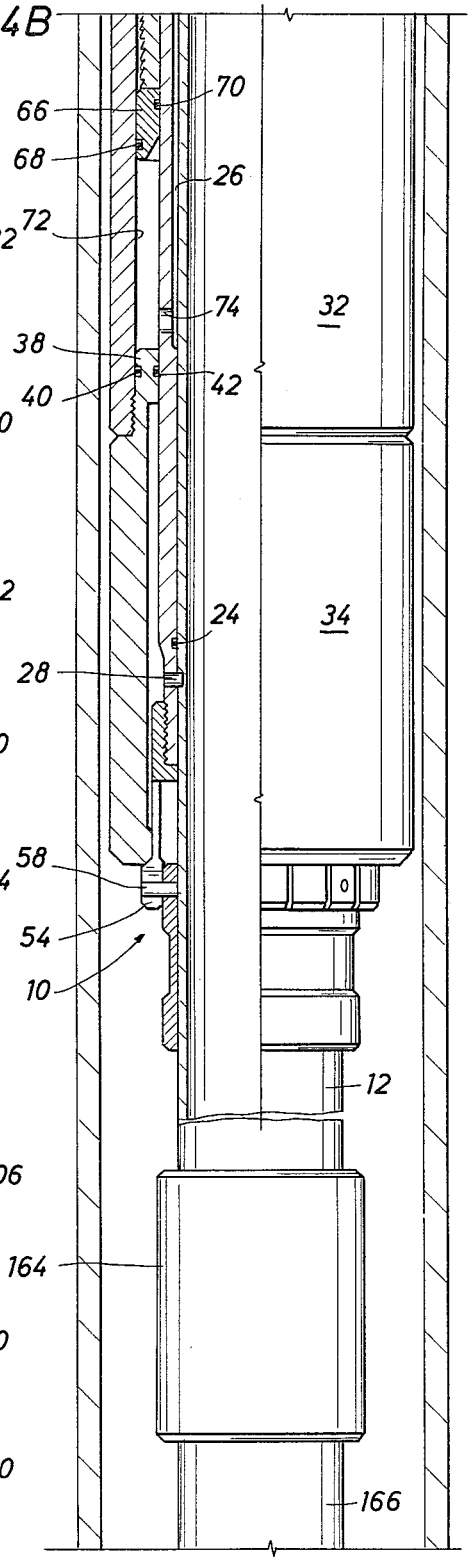

With the slip members 88 thus partially set, wedged between the well conduit 172 and the upper cone assembly 110, increased hydraulic pressure applied to the pressure chamber 72 to propel the piston 66 further upwardly causes the outer shear pins 106 to break, permitting upward movement of the lower cone assembly 96 relative to the slip cage 84 (FIGS. 4A and 4B). The relative axial movement between the lower cone assembly 96 and the slip cage 84 repositions the pins 102 upwardly within the respective cage slots 104. Such upward movement by the lower cone assembly 96 results in the wedging of the frusto-conical wedge surface 98 against the camming surfaces 100 of the slip members 88, completing the setting of the anchoring assembly 18. At the same time, the locking ring 76 further ratchets upwardly along the threads 82 of the collet fingers 80 so that the anchoring assembly 18 is locked in its fully set configuration. Then, any tendency of the lower cone assembly 96 to move upwardly relative to the slip cage 84 results in a further tightening of the wedging of the slip members 88 between the lower cone assembly wedging surface 98 and the well conduit 172.

The packer outer assembly 14 is completely anchored to the conduit 172 as shown in FIGS. 4A and 4B. Any tendency of well fluid pressure acting on the seal member 150 to move the packer 10 longitudinally upwardly or downwardly is countered by increased wedging forces by the cone assembly 96 or 110, respectively, driving the slip members 88 into tighter gripping engagement with the well conduit 172.

It will be appreciated that the packer 10 is fully set and locked in its set configuration, as illustrated in FIGS. 4A and 4B. The setting operation is completed without the breaking of the shear pins 58 securing the latch dogs 54 in place, or the breaking of the shear pins 28 maintaining the longitudinal alignment of the packer outer assembly 14 relative to the mandrel 12.

With the packer 10 thus set, the mandrel 12 and, therefore, the attached tubing string is sealed to the well conduit 172 by the primary seal members 150 and the mandrel seal assembly 140. The remaining seal elements 22, 24, 40, 42, 68 and 70 are no longer essential to the further operation of the packer 10. Consequently, though the packer 10 may be exposed to high temperatures during its use in a well, the aforementioned O-ring seals are expendable, and therefore need not be constructed of material which will accommodate the anticipated high temperatures.

With the packer 10 thus completely set, as illustrated in FIGS. 4A and 4B, the mechanism used to plug the tubing string for the setting of the packer may be removed. For example, the ball valve element 170 (FIGS. 2A-3B) may be flowed up the tubing string if the packer 10 has been set in a producing well. Otherwise, means may be provided for disposing of the ball 170, or other plugging means, either up or down the well. It will be appreciated that the specific seat 168 and ball 170 combination is shown and described herein for purposes of illustration rather than limitation, and may be modified as needed to provide a plugging means so disposable up or down the well. For example, the seat 168 may be part of a separate ring held within the sub 166 by shear screws which break upon application of hydraulic pressure in the tubing string in excess of that required to set the packer 10. In such case, the seating ring may be sealed to the sub 166 by an O-ring seal, for example. Such a seating device is illustrated in U.S. Pat. No. 3,090,442, which is incorporated herein by reference. U.S. Pat. No. 4,114,694, also incorporated herein by reference, discloses plugging apparatus which may be released upon decrease of fluid pressure within the tubing string. Other plugging devices are known. The particular plugging device utilized with the packer 10 may be selected, for example, as directed by the circumstances of the well in which the packer is set.

Upon a decrease of the fluid pressure in the tubing string, and removal of the plugging device, the packer 10 remains both anchored and sealed to the surrounding well conduit 172. The packer 10 is locked in its set configuration by the cooperative engagement of the locking ring threads 78 with the upper sleeve member threads 82. With fluid pressure in the chamber 72 decreased, the piston 66 may fall to the piston head 38, for example, in the absence of sufficient friction to support the piston.

The mandrel may be moved longitudinally relative to the set packer outer assembly 14 without disturbing the sealing engagement between the mandrel 12 and the conduit 172. Sufficient force may be applied to the tubing string at the surface to break the shear pins 28. Then, the tubing string may be moved longitudinally to the extent permitted by the distance between the top of the retainer ring 132 and the bottom of the collar 162 in the running in configuration (FIG. 1A), and the distance between the bottom of the back-up collar 56 and the top of the collar 164 in the running in configuration (FIG. 1B). Downward movement by the tubing string will be limited by the collar 162 engaging the retainer ring 132 of the anchored outer packer assembly 14. Upward movement by the tubing string will be limited by the top of the collar 164 contacting the bottom of the collar 56. The shear pins 58 may be of sufficient breaking threshold to require a noticable increase of applied force to raise the tubing string once such contact between the collar 164 and the collar 56 has been attained. Consequently, the operator at the surface will be signaled when the tubing string is raised to effect such collar contact.

The length of the mandrel 12 relative to the length of the outer packer assembly 14 may be sufficiently large to allow the selective placement of the mandrel ports 30 above the mandrel seal 140 to permit circulation of fluid between the interior of the tubing string and the annular region between the tubing string and the well conduit 172 above the set packer seal assembly 16. Similarly, within the axial movement limitations of the mandrel 12 relative to the set packer outer assembly 14, the tubing string may be lowered to position the mandrel ports 30 below the collar 56, for example, to facilitate fluid flow through the ports 30 when it is desired to communicate fluid between the interior of the tubing string and the annular region between the tubing string and the well conduit 172 below the set packer seal assembly 16.

Figure 5A:
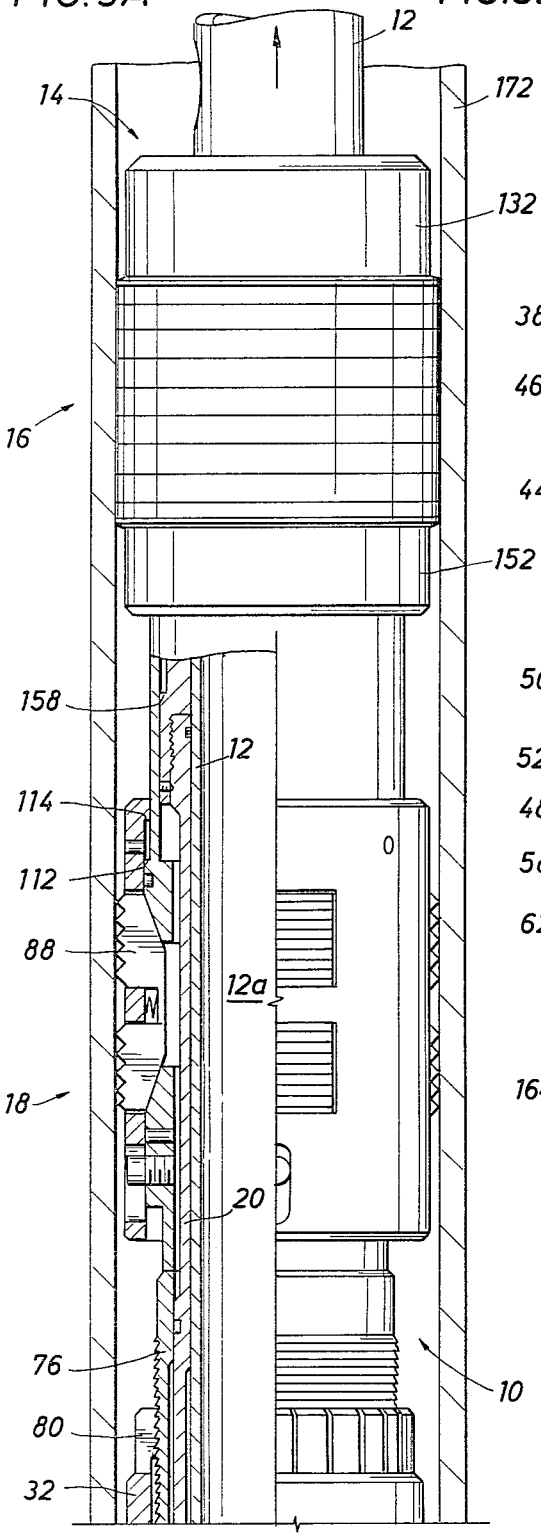
FIGS. 5A and 5B combined illustrate the packer of FIGS. 4A and 4B with the outer packer assembly unlatched.
Figure 5B:
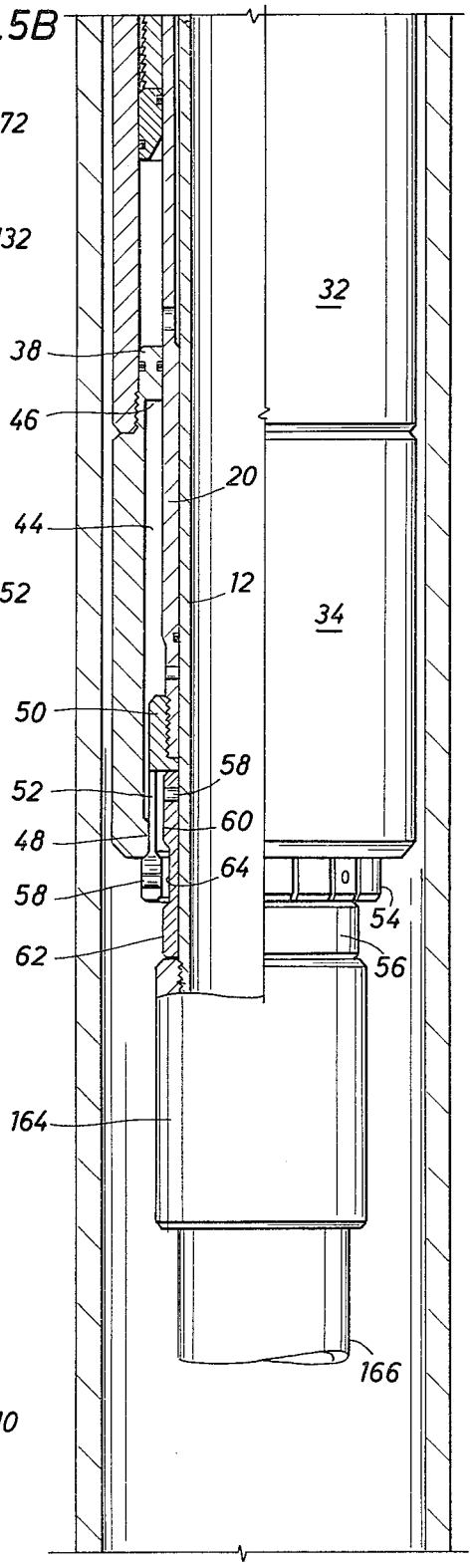

The packer may be released from its set configuration and retrieved from the well by a straight upward pull on the tubing string. If the shear pins 28 have not yet been broken, an initial upward pull on the tubing string will break these pins. To unset the packer 10, the tubing string is raised to engage the collar 164 with the collar 56. Then, with sufficient upward force applied to the tubing string at the surface, the collar 164 is raised to break the shear pins 58, allowing the collar 56 to be moved upwardly relative to the dogs 54 (FIGS. 5A and 5B).

As the back-up collar 56 is then raised with the mandrel 12, the shoulder 60 is moved up from behind the dogs 54. The length of the reduced outer diameter profile 64 of the collar 56 is sufficient to receive the dogs 54, as the collar is raised to place the profile 64 in registration with the dogs. The packer outer assembly 14 is then effectively unlatched. At that point, the top of collar 56 abuts the collar assembly 50 within the collet arms 52, as illustrated in FIG. 5B. Continued upward movement by the operating string forces the collet assembly 50, and elements attached thereto, upwardly relative to the well conduit 172.

It will be appreciated that the tubular member 20, the seal mandrel 124, the mandrel seal assembly 140 and the retainer ring 132 may be thus be propelled upwardly relative to the anchoring assembly 18, for example, which is still in gripping engagement with the well conduit 172. Also, the collet assembly 50 and elements attached thereto are raised, by operation of the tubing string, relative to the locking ring 76, the upper sleeve member 32 and the lower sleeve member 34.

As the collet assembly 50 is driven upwardly due to continued upward pulling on the tubing string, the dogs 54 ride around the shoulder 54, being received within the profile 64, as the collet arms 52 flex radially inwardly.

Figure 6A:
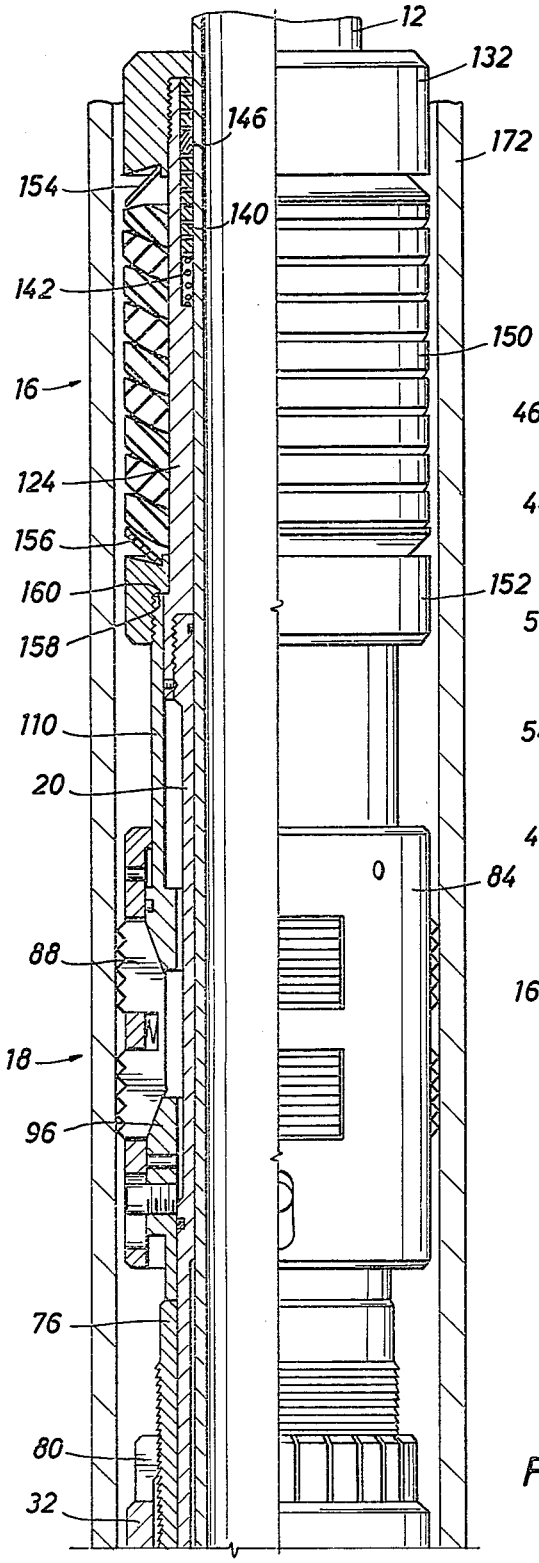
FIGS. 6A and 6B combined are similar to FIGS. 5A and 5B combined, but illustrate the seal assembly released from engagement with the casing.
Figure 6B:
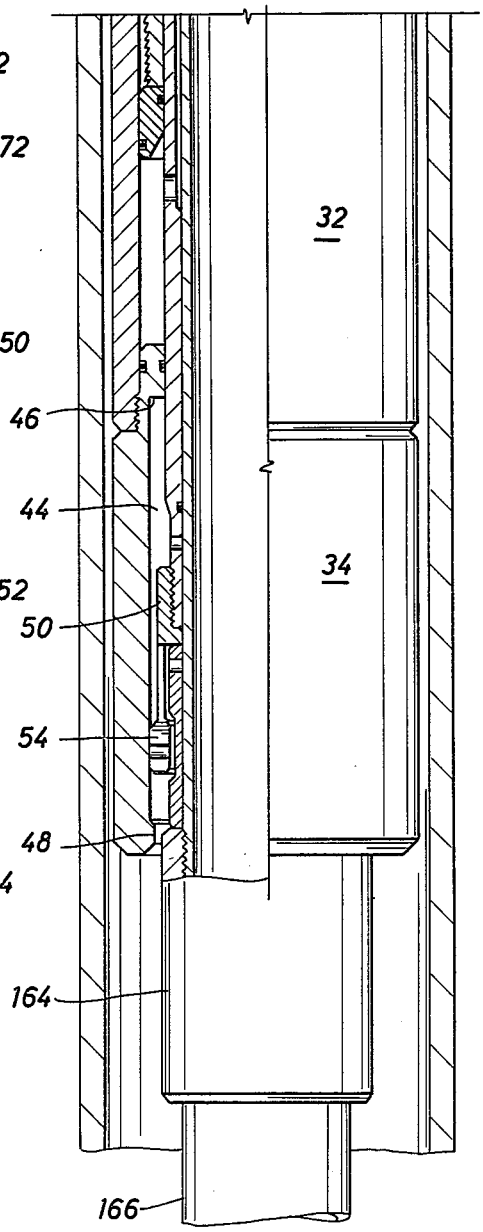

As the collar 56 is raised to move the collet assembly 50 upwardly, the tubular member 20 is raised to drive the seal mandrel 124 and the seal retainer ring 132 upwardly to release the primary seal members 150 from setting configuration, as indicated in FIGS. 6A and 6B. As the retainer ring 132 is raised relative to the compression ring 152, the axial compression of the seal members 150 is relaxed, allowing these seal members to retract radially inwardly out of sealing engagement with the well conduit 172. At that point, the packer 10 is no longer sealed to the well conduit 172, although the mandrel seal assembly 140, with its seal members 146 maintained under axial compression due to the coil spring 142, maintains sliding sealing engagement between the seal mandrel 124 and the mandrel 12.

Figure 7:
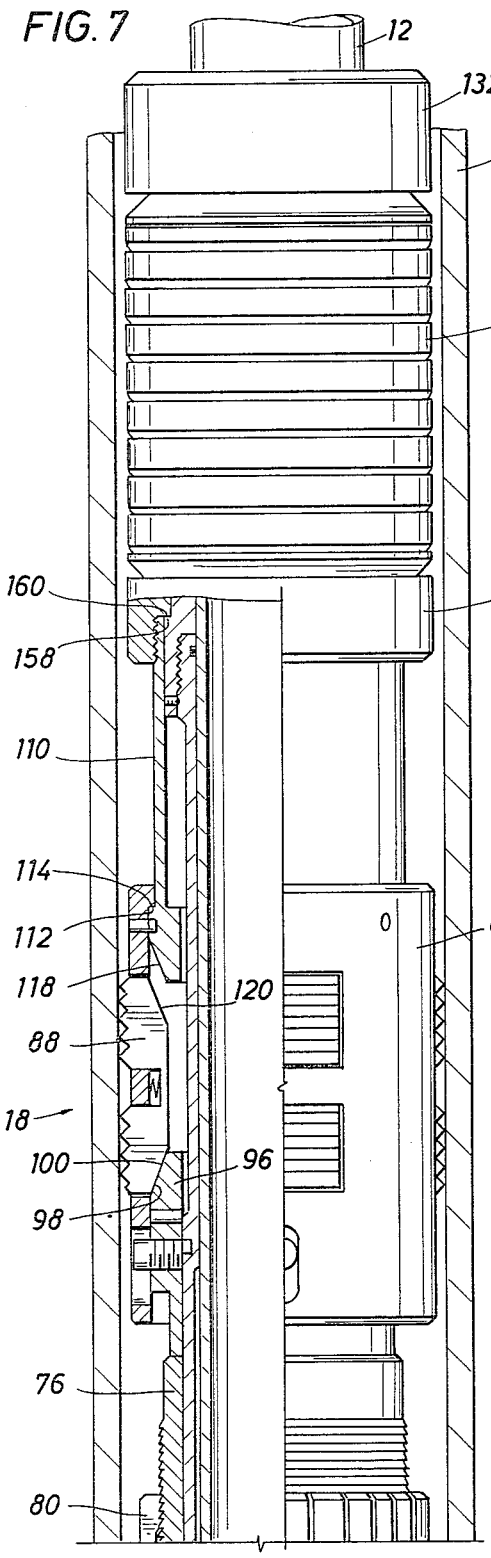
FIG. 7 is a view of the top portion of the packer similar to FIG. 6A, illustrating the slip members partially released.

Continued raising of the tubing string relative to the well conduit 172 results in unsetting the anchoring assembly 18. As the tubular member 20 and the seal mandrel 124 are raised by operation of the tubing string, the shoulder 158 of the seal mandrel eventually abuts the shoulder 160 of the compression ring 152. Then, further upward movement by the tubular member 20 and the seal mandrel 124 lifts the compression ring 152 and the attached upper cone assembly 110 to remove the wedging contact between the wedging surface 118 and the slip member camming surfaces 120, as shown in FIG. 7.

Figure 8:
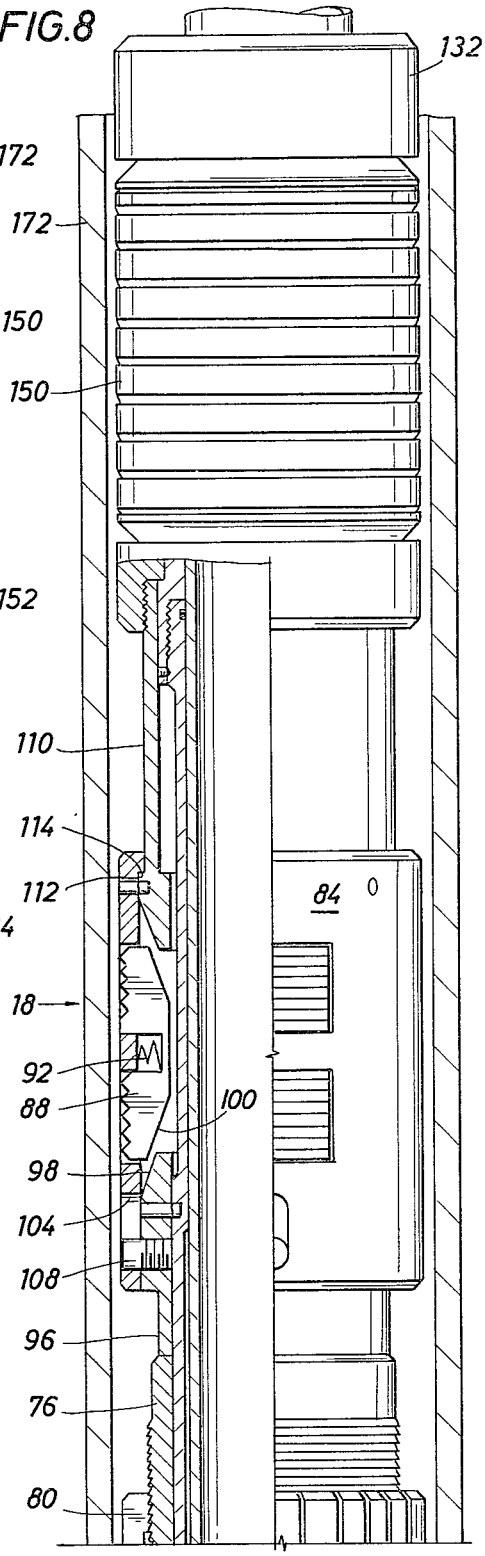
FIG. 8 is a view similar to FIG. 7, showing the packer in complete release configuration.

As the upper cone assembly 110 is further raised relative to the well conduit 172, eventually the shoulder 112 abuts against the shoulder 114 of the slip cage 84. The upper cone assembly 110 lifts the slip cage 84 and the slip members 88 relative to the lower cone assembly 96, removing the camming surfaces 100 from the wedging surface 98. Then, the anchoring assembly 18 is completely unset, and the compressed coil springs 92 propel the slip members 88 radially inwardly out of engagement with the well conduit 172, as illustrated in FIG. 8. The packer 10 is then completely free of any sealing or anchoring engagement with the well conduit 172, and is totally supported by the tubing string with which the packer may be removed from the well.

In the release configuration of FIG. 8, the pins 102 may be caught by the lower extremities of the slip cage slots 104 to raise the lower cone assembly 96 with the slip cage. It will be appreciated that the packer 10 has been completely released from its set configuration without disengagement of the locking ring 76 from the collet fingers 80. However, unless the locking ring 76 and the lower cone assembly 96 are of unitary construction, the locking ring and the upper and lower sleeve members 32 and 34, respectively, are lifted from the well by abutting engagement of the top of the collet assembly 50 with the shoulder 46 of the lower sleeve member (FIG. 6B). The distance between the top of the collet assembly 50 and the shoulder 46 in the running in configuration of the packer 10 (FIGS. 1A and 1B) is at least as large as the total travel of the piston 66 throughout the entire setting operation. Thus, sufficient axial space is provided within the recess 44 to permit the collet assembly 50 to be raised with the tubing string to the extent necessary to completely unset the packer 10.

As the operating string is lifted to unlatch the set packer 10, the mandrel ports 30 are positioned above the seal assembly 16 (FIGS. 5A and 5B). It will be appreciated that the mandrel ports 30 are positioned above the outer packer assembly 14 when the packer 10 is completely released for retrieval from the well. Thus, well fluids may freely circulate between the interior of the tubing string and the annular region between the tubing string and the well conduit 172 as the packer is being lifted, thereby minimizing fluid pressure resistance to such movement of the packer through the conduit. Additionally, fluid may be circulated in either direction through the mandrel ports 30 above the outer assembly 14 to remove from the annulus above the outer assembly material which might tend to prevent retrieval of the packer from the well.

The present invention provides a hydraulically set well packer which may be fitted with seal members to provide sealing engagement between the tubing string and the well conduit effective in high temperature well conditions. With the packer set, the central mandrel is free-floating, and may be axially stroked a distance limited generally only by the difference in length between the outer packer assembly and the mandrel itself. During such movement, the mandrel remains sealed to the well conduit. The freedom of movement of the mandrel relative to the anchored outer packer assembly also permits the tubing string to expand or contract, in response to temperature extremes caused by well working operations, without unsetting the packer, and without disturbing the integrity of the seal between the tubing string and the well conduit. Thus, the present invention provides a well packer for use in either a producing well or an injection well in thermal recovery operations.

A packer according to the present invention features anchoring slip members of appropriate number, though four are indicated for purposes of illustration. The slip members function between opposed wedging surfaces to hold the packer locked against longitudinal movement relative to the surrounding well conduit in either axial direction sense. Further, as the packer is being set, hydraulic pressure effectively acts in opposite axial direction senses to tighten the sealing engagement of the packer with the surrounding well conduit, as well as to tighten the gripping engagement of the anchoring assembly with the well conduit.

As the packer is set, it is locked in set configuration. A first locking member is releasably held fixed to a tubular body of the setting elements, and is grippingly engaged by a second locking member as the packer is being set. A collet-mounted dog assembly is held in latched configuration by a collar acting as a stop to so fix the first locking member to the tubular body and thus prevent relative longitudinal movement of the setting elements to unset the packer. A straight longitudinal movement of the central mandrel with sufficient force may break frangible pins to move the stop and release the latching mechanism. Further mandrel movement may then unset the packer.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. A well tool adapted to be releasably set internally of a well conduit comprising:

a. a central mandrel extending generally within an outer assembly;

b. seal means, as part of said outer assembly, for providing sealing engagement with said mandrel, and movable generally radially between a retracted configuration and an extended configuration in which said seal means sealingly engages said conduit;

c. anchoring means, as part of said outer assembly, movable generally between a retracted position and an extended position in which said anchoring means grippingly engages said conduit;

d. setting means, as part of said outer assembly, responsive to fluid pressure whereby at least a portion of said setting means may be propelled axially for so moving said seal means to said extended configuration, and so moving said anchoring means to said extended position;

e. locking means, responsive to said setting means for locking said seal means in said extended configuration and locking said anchoring means in said extended position;

f. release means, for selectively releasing said setting means to permit movement of said seal means out of said extended configuration and said anchoring means out of said extended position, said release means including collet-mounted latch means selectively movable out of latching configuration, for so releasing said setting means, by selective axial movement of said mandrel; and g. wherein said mandrel is permitted limited axial movement relative to said outer assembly with said seal means in said extended configuration and said anchoring means in said extended position without so moving said latch means out of said latching configuration.

2. A well tool as defined in claim 1 wherein said seal means comprises a plurality of annular resilient seal members mounted on a tubular member and axially compressed to extend radially inwardly to sealingly engage said central mandrel.

3. A well tool as described in claim 1 wherein said seal means comprises seal members for so engaging said mandrel and for so engaging said conduit, said seal members of construction to be operable at high temperatures.

4. A well tool as defined in claim 1 wherein said setting means further comprises:

a. an elongate tubular body carrying said seal means, including compression means operable for so moving said seal means to said extended configuration;

b. wedge means operable for moving said anchoring means to said extended position; and c. piston means, responsive to fluid pressure, for so operating said compression means and for so operating said wedge means.

5. A well tool as defined in claim 4 wherein:

a. said locking means further comprises first locking means held by said latch means, in said latching configuration, against relative movement between said first locking means and said tubular body, and second locking means operable in response to said piston means for engaging said first locking means to maintain said seal means in said extended configuration and said anchoring means in said extended position; and b. wherein said tubular body is movable relative to said first locking means, upon said latch means moving out of said latching configuration, to permit said compression means to release said seal means to move out of said extended configuration, and to permit said wedge means to release said anchoring means to move out of said extended position.

6. A well packer comprising:

a. a central mandrel connectable to a tubing string;

b. an outer packer assembly including a seal assembly, for sealing said outer assembly to said central mandrel and for selectively sealing said outer assembly to a circumscribing well conduit, and an anchoring assembly for selectively anchoring said outer assembly to such a conduit, said seal assembly comprising first resilient annular seal members mounted on a tubular body wherein said first seal members are selectively radially expandable to so engage said well conduit upon axial compression of said first seal members and second resilient annular seal members mounted on said tubular body and axially compressed to extend radially inwardly to provide slidable sealing engagement with said mandrel and said anchoring assembly comprising a plurality of anchoring members selectively movable radially outwardly to so provide anchoring engagement with said well conduct;

c. setting means, as part of said outer assembly, for selectively moving said seal assembly into sealing engagement with said conduit, and for selectively moving said anchoring assembly into anchoring engagement with said conduit, said setting means comprising compression means for so selectively axially compressing said first seal members, wedge means for so selectively propelling said anchoring members radially outwardly, and piston means, responsive to fluid pressure for so operating said compression means to axially compress said first seal members, and for so operating said wedge means for so propelling said anchoring members radially outwardly;

d. locking means, as part of said outer assembly, for locking said seal assembly and said anchoring assembly in engagement with said conduit, said locking means comprising a first locking member releasably held fixed relative to said tubular body and a second locking member movable in response to said piston means, and for grippingly engaging said first locking member as said compression means is so operated and as said wedge means is so operated whereby, with said first and second locking members so mutually grippingly engaged, said first seal members may be prevented from moving out of engagement with said conduit and said anchoring members may be prevented from moving out of engagement with said conduit;

e. release means, operable in response to longitudinal movement by said central mandrel relative to said outer assembly, whereby said seal assembly and said anchoring assembly may be released for movement out of engagement with said conduit, said release means comprising collet-mounted latch means for releasably latching said tubular body with said first locking member, stop means, for maintaining said latch means in latching configuration between said tubular body and said first locking member, said stop means selectively movable by longitudinal movement of said central mandrel to permit said latch means to move out of said latching configuration, and frangible means for maintaining said stop means in configuration to prevent release of said latch means from latching configuration in the absence of sufficient force exerted by means of said mandrel;

f. wherein said release means is operable to release said first locking member from said tubular body for relative movement therebetween whereby said first seal members may be released from axial compression by said compression means to move out of engagement with said conduit and whereby said anchoring members may be released from operation by said wedging means to move out of engagement with said conduit; and g. wherein, with said seal assembly and said anchoring assembly engaging said conduit, said central mandrel is permitted at least limited axial movement relative to said outer assembly without so operating said release means.

7. A well packer comprising:

a. a central mandrel connectable to a tubing string;

b. an outer packer assembly including a seal assembly, for sealing said outer assembly to said central mandrel and for selectively sealing said outer assembly to a circumscribing well conduit, and an anchoring assembly for selectively anchoring said outer assembly to such a conduit;

c. setting means, as part of said outer assembly, for selectively moving said seal assembly into sealing engagement with said conduit, and for selectively moving said anchoring assembly into anchoring engagement with said conduit, said setting means comprising compression means for operating on said seal assembly for effecting said sealing of said outer assembly to said well conduit, wedge means for operating on said anchoring assembly for effecting sealing and anchoring of said outer assembly to said conduit, and piston means, responsive to fluid pressure for so operating said compression means and said wedge means for effecting sealing and anchoring engagement respectively, between said outer assembly and said conduit;

d. locking means, as part of said outer assembly, for locking said seal assembly and said anchoring assembly in engagement with said conduit;

e. release means, operable in response to longitudinal movement by said central mandrel relative to said outer assembly, whereby said seal assembly and said anchoring assembly may be be released for movement out of engagement with said conduit; and f. wherein, with said seal assembly and said anchoring assembly engaging said conduit, said central mandrel is permitted at least limited axial movement relative to said outer assembly without so operating said release means.

8. A well packer comprising:

a. a central mandrel connectable to a tubing string;

b. an outer packer assembly including a seal assembly, for sealing said outer assembly to said central mandrel and for selectively sealing said outer assembly to a circumscribing well conduit, and an anchoring assembly for selectively anchoring said outer assembly to such a conduit;

c. setting means, as part of said outer assembly, for selectively moving said seal assembly into sealing engagement with said conduit, and for selectively moving said anchoring assembly into anchoring engagement with said conduit;

d. locking means, as part of said outer assembly, for locking said seal assembly and said anchoring assembly in engagement with said conduit;

e. release means, operable in response to longitudinal movement by said central mandrel relative to said outer assembly, whereby said seal assembly and said anchoring assembly may be released for movement out of engagement with said conduit, said release means comprising collet-mounted latch means for releasably latching said locking means to said setting means such that disengagement of said latch means to release said setting means from said locking means permits said seal assembly and said anchoring assembly to move out of sealing and anchoring engagement, respectively, with said conduit, stop means, for maintaining said latch means in latching configuration between said setting means and said locking means, said stop means being selectively movable by longitudinal movement of said central mandrel to permit said latch means to move out of said latching configuration, and frangible means for maintaining said stop means in configuration to prevent release of said latch means from latching configuration in the absence of sufficient force exerted by means of said mandrel; and f. wherein, with said seal assembly and said anchoring assembly engaging said conduit, said central mandrel is permitted at least limited axial movement relative to said outer assembly without so operating said release means.

9. A method of operating a packer in a well comprising the following steps:

a. positioning in a well packer with seal means operable at high temperatures;

b. communicating fluid pressure to the packer to:

i. propel such seal means of the packer into sealing engagement with the well;

ii. propel anchoring means of the packer into anchoring engagement with the well; and iii. lock the seal means and anchoring means in such engagement with the well;

c. selectively longitudinally moving a central mandrel of the packer, connected to an operating string within the well, relative to the anchoring means of the packer without disturbing the sealing engagement between the packer and the well, and while maintaining sealing engagement between the packer and the central mandrel;

d. raising the central mandrel of the packer to longitudinally move a stop from registration with latch dogs within the packer to release the seal means and the anchoring means for movement out of their respective engagements with the well; and e. further raising the central mandrel to so move the seal means out of sealing engagement with the well and to move the anchoring means out of anchoring engagement with the well.

* * * * *